United States Patent [19]

Willem

[11] 4,291,741

[45] Sep. 29, 1981

[54] METHOD OF FIXING A METAL STRENGTH MEMBER ON A NON-METAL PART

[75] Inventor: Michel Willem, Vichy, France

[73] Assignee: Ceraver, Paris, France

[21] Appl. No.: 84,205

[22] Filed: Oct. 12, 1979

[30] Foreign Application Priority Data

Oct. 13, 1978 [FR] France ..... 78 29245

[51] Int. Cl.[3] ..... B22D 19/00

[52] U.S. Cl. ..... 164/9; 164/75; 164/76.1; 164/98

[58] Field of Search ..... 164/9–11, 164/75, 98–101, 107, 108, 76; 29/631

[56] References Cited

U.S. PATENT DOCUMENTS

| | | | |
|---|---|---|---|
| 397,641 | 2/1889 | Halford et al. | 164/75 |
| 1,695,458 | 12/1928 | Goddard | 164/100 |
| 1,955,981 | 4/1934 | Smith | 164/75 |
| 3,461,944 | 8/1969 | Kuebrich | 164/75 X |
| 3,964,536 | 6/1976 | Willem | 164/98 |
| 4,114,676 | 9/1978 | Willem | 164/98 X |

FOREIGN PATENT DOCUMENTS

| | | | |
|---|---|---|---|
| 379841 | 8/1923 | Fed. Rep. of Germany . | |
| 2248148 | 4/1974 | Fed. Rep. of Germany | 164/100 |
| 1253881 | 1/1961 | France . | |
| 1444163 | 5/1966 | France . | |

*Primary Examiner*—Robert D. Baldwin
*Assistant Examiner*—J. Reed Batten, Jr.
*Attorney, Agent, or Firm*—Sughrue, Mion, Zinn, Macpeak and Seas

[57] ABSTRACT

The invention relates to fixing a metal strength member on a non-metal part. A heat-resistant fibre glass layer is inserted between the strength member and the non-metal part, the layer extending throughout at least the zone of the non-metal part which corresponds to the point where the molten metal which forms the strength member is injected and being coated with a non-adhering inert inorganic substance so that the layer is thus compressed between the non-metal and the metal part when the metal part is applied against the non-metal part. Application in particular to manufacturing tempered glass electric insulators with moulded aluminium caps.

7 Claims, 5 Drawing Figures

METHOD OF FIXING A METAL STRENGTH MEMBER ON A NON-METAL PART

FIELD OF THE INVENTION

The present invention relates to a method of fixing a metal strength member on a non-metal part by moulding the metal or the alloy of the strength member in the molten state onto the head of the non-metal part, said part being, for example, an insulating component of an electric insulator, made of ceramic, glass or porcelain.

BACKGROUND OF THE INVENTION

To provide improved protection of the non-metal part against thermal shock, the present assignees' U.S. Pat. No. 3,964,536 discloses one or several closely applied metal parts on at least part of the head, the metal part advantageously being in the form of a sleeve made of a metal which is a good heat conductor (and/or a ring) crimped on the head.

In some circumstances, the invention of the above-mentioned patent gives rise to difficulties. Indeed, with an aluminium or aluminium alloy sleeve crimped on the head of a glass electrically insulating part, the combined effect of temperature and pressure during injection of the metal for forming the moulded cap can cause a degree of adherence of the sleeve- constituting metal sheet on the tempered glass surface, especially in the zone directly subjected to the molten metal. Such adherence is undesirable, since on cooling, small cracks can appear in the surface of the glass down to a depth of about 5 to 50 microns.

To solve this problem it was then contrived to use lubricants or mould-stripping products such as molybdenum bisulphide aerosols, for example. However, this is not entirely satisfactory, since fairly frequently the surface of the glass still adheres to some degree to the metal sheet in the hottest zone; further, under the effect of heat, the mould-stripping agents or the dispersion fluids can evolve gas which forms bubbles between the metal sheet and the glass.

Preferred embodiments of the present invention improve the method of the above-mentioned patent and considerably reduce the danger of adherence of the metal on the tempered glass surface, particularly in the zone in which the effects of temperature and pressure combine when the molten metal is injected.

SUMMARY OF THE INVENTION

More particularly, the present addition provides a method of fixing a metal strength member on a non-metal part by moulding the metal or the alloy of the strength member in the molten state on the head of the non-metal part, in which method one or several metal parts are closely applied on at least part of said head. The present method is characterized in that a fibre glass layer is inserted, said layer extending throughout at least that zone of the head which corresponds to the area where the molten metal is injected, said area bearing an inert non-adhering inorganic substance, so that said layer is compressed between the head and the metal part when the metal part is applied against said head.

The method of the invention may also include at least one of the following characteristics:

In the case of a metal part in the form of a sleeve-shaped cap which is made of a metal which is a good heat conductor, the layer is a disk disposed at the bottom of the sleeve before it is crimped on the head or else when the layer is installed on the bottom of the sleeve, it is cupped to match exactly the bottom of the sleeve and the side walls thereof in the neighbourhood of said bottom. The layer is cupped by simple compression when the sleeve is installed and crimped on the head;

The case of a metal part in the form of a sleeve-shaped cap which is made of a metal which is a good heat conductor, and when a molten metal is injected which is directed towards the side surface of the head, the layer, which is ring-shaped, is installed on the head before the sleeve is crimped on said head. The ring extends throughout at least the zone which corresponds to the point where the molten metal which forms the cap is injected;

Before the metal part or parts are installed, any portion of the head not in contact with the layer is coated with an inert inorganic substance analogous to that on the layer;

The layer is very thin and its weight per unit area lies between 10 g/m$^2$ and 50 g/m$^2$, the preferred value being 26 g/m$^2$; and The inert inorganic substance on the layer is constituted mainly by a powdered material such as talc or alumina.

Other characteristics and advantages of the invention will become more clearly apparent from the following description, given by way of a non-limiting illustration with reference to the figures of the accompanying drawings.

DESCRIPTION OF THE PREFERRED EMBODIMENT

Figure 1:
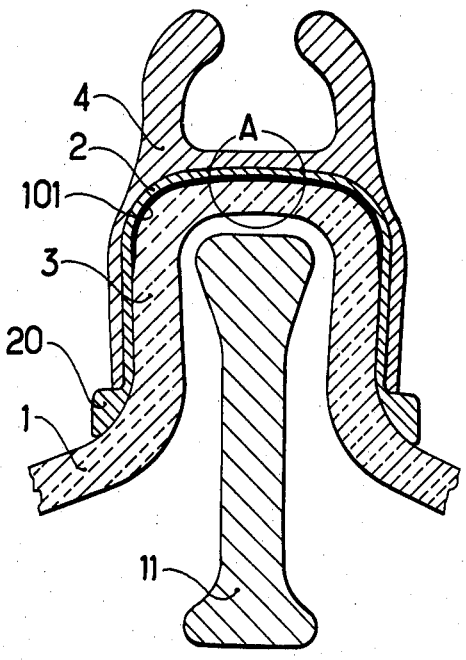
FIG. 1 is an axial cross-section of a cap and rod type insulator in which a metal sleeve with a collar on its end is disposed on the head and in which, in accordance with the invention, a cup made of a fibre glass layer coated with an inert inorganic substance is compressed between the sleeve and the head.

The insulator illustrated in FIG. 1 is constituted, as in the above-mentioned patent, by a body 1 made e.g. of tempered glass disposed on the head of a metal rod 11. A metal sleeve 2 with a thin collar 20 is disposed on the body 1. It is easily deformable and preferably made of a metal which is a good heat conductor, said sleeve being crimped closely to the head 3 of the body by electromagnetic pressure, by isostatic pressure, by collapsing an elastomer cylinder, or by any other equivalent means. Said body with its sleeve is then placed in a mould (not shown) and provided with a cap 4 by casting molten metal or molten alloy.

Figure 2:
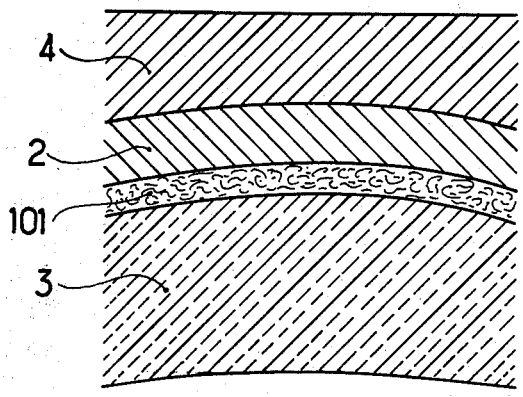
FIG. 2 ia an enlarged sectional view which illustrates the detail A of FIG. 1 on an enlarged scale.

To prevent possible adherence between the sleeve and the head of the body, in particular in the zone which corresponds to the area where the molten metal which forms the cap is injected, a fibre glass layer 101 is provided, at least in said zone where molten metal injection is performed, said layer bearing an inert non-adhesive inorganic substance, said layer thus being compressed between the head 3 and the metal sleeve 2 when the sleeve is applied agaist said head. FIG. 2 shows more clearly a cross-section of the layers in FIG. 1. It is an illustration on an enlarged scale of the detail A in FIG. 1.

Here, the layer is very thin and its weight per unit area lies between 10 g/m$^2$ and 50 g/m$^2$ and is preferably 26 g/m$^2$. The layer bears an inert powdered inorganic substance which is preferably talc or alumina; inert inorganic substances prevent gas from being evolved and especially prevent contamination - a danger which lubricants do not avoid.

Figure 3:
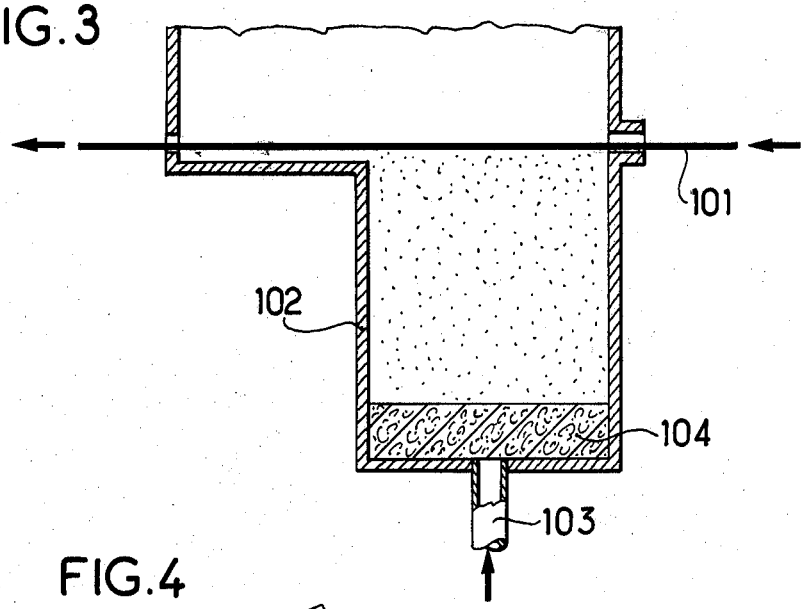
FIG. 3 is a sectional view which illustrates schematically the preparation of a layer such as used in the present invention.
Figure 4:
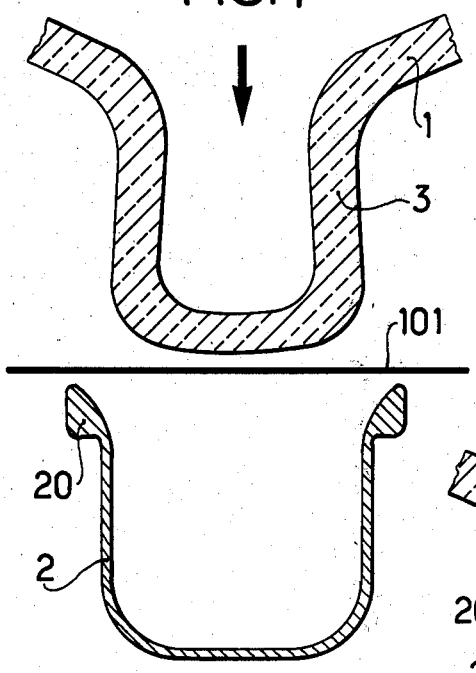
FIGS. 4 and 5 are sectional views which illustrate the nature of insertion of the layer between the sleeve and the head before injection of the moulded cap.
Figure 5:
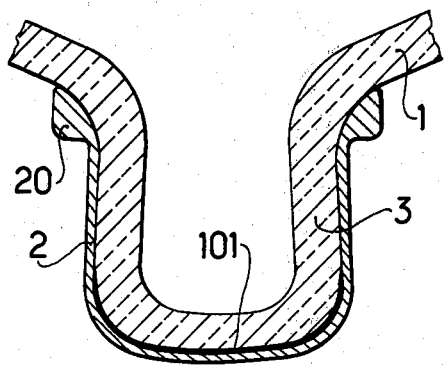

FIG. 3 illustrates an example of packing in which the layer 101 (in a strip and not cut to the final required shape) passes through a fluidized bath of talc or alumina in a chamber 102. A compressed air inlet 103 below aporous plate 104 is provided in the bottom of said chamber. The layer 101 is then cut into the required shape and collapsed by pressing the corresponding surfaces of the tempered glass (head 3) and of the aluminium sheet (sleeve 2) against each other as shown schematically in FIG. 4. When the layer 101 is installed at the bottom part of the sleeve, it is cupped to match exactly the bottom of the sleeve and the side walls thereof in the neighbourhood of said bottom, by compression when installing and when crimping the sleeve on the head, as shown in FIG. 5. The layer can, of course, extend throughout the whole inner surface of the metal sleeve, including, possibly, below the associated collar. Then, it is necessary only to insert the body with it compressed layer an its crimped sleeve in a mould, leaving a volume which corresponds to the cap 4 between the inner walls of the mould, the outer surface of the sleeve and a connection point between the mould and the body (the collar 20 here forming the connection area), the cap being formed by casting molten metal or molten alloy in the above-defined volume, the casting temperature for an aluminium cap being about 680° C. As described in the above-mentioned patent, the sleeve 2 prevents the molten mass from coming directly into contact with the glass or ceramic substance and consequently reduces the thermal shock; the sleeve heats up when the stream of cast material comes into contact with it and, due to its high heat conductivity, distributes the heat throughout the surface of the head 3. This compensates local thermal stresses. The improvement provided by the present invention eliminates or at least greatly reduces adherence between the glass and the sleeve and considerably reduces danger of cracking of the surface of the glass on the cooling thereof.

Here, the layer 101 is cut to form a cup at the bottom of the sleeve, but this is non-limitative: it can equally well be cut to form a simple disk which covers only the bottom of the sleeve, or, even, in the case where the metal or alloy is laterally injected, it can be cut to form a cylindrical ring which is then installed on the head before the sleeve is crimped on said head, said ring covering at least the zone where the molten metal is injected. The layer can also be preformed to some extent before it is installed.

It would also be advantageous before the sleeve is installed to coat any portion of the head not in contact with the layer, with an inert inorganic substance analogous to that on the layer.

The technical advantage provided by the present invention is thus evident, particularly with respect to the functions performed by the main components, the main function of the layer being to support the inert inorganic substance and its secondary function - a further advantage - being heat insulation; the main function of the inert inorganic substance being the prevention of adherence between the glass and the metal sleeve without contamination or evolving gas.

I claim:

1. A method of fixing a metal strength member on a non-metal part by moulding the metal of the strength member in the molten state on the head of the non-metal part, over a metal sleeve initially closely applied on at least part of said head, the improvement comprising the step of:

inserting a fibre glass layer throughout at least tha zone of the head which corresponds to the area where the molten metal is moulded, between said metal sleeve and said head, with said layer bearing an inert non-adhering inorganic substance, so that said layer is compressed between the head and the metal sleeve when the metal sleeve is applied against said head during moulding of said metal strength member.

2. A method according to claim 1, wherein said sleeve is in the form of a sleeve-shaped cap which is made of a metal which is a good heat conductor, and said step of inserting a fibre glass layer comprises disposing a fibre glass disc at the bottom of the sleeve-shaped cap before it is closely applied on the head.

3. A method according to claim 1, wherein the metal sleeve is in the form of a sleeve-shaped cap which is made of a metal which is a good heat conductor, and wherein the fibre glass layer is cupped to match exactly the bottom of the sleeve and the side walls thereof in the neighbourhood of the said bottom, when the said layer is installed in the bottom of the sleeve, and wherein said layer is cupped by simple compression when the sleeve is closely applied on the head.

4. A method according to claim 1, wherein the molten metal is moulded towards the side surface of the head and the metal sleeve is in the form of a sleeve-shaped cap which is made of a metal which is a good heat conductor, and the layer is ring-shaped and is installed on the head before the sleeve is closely applied on said head, said ring extending throughout at least the zone which corresponds to the area where the molten metal which forms the cap is moulded.

5. A method according to claim 1, wherein, before the metal sleeve is closely applied, any portion of the head not in contact with the fibre glass layer is coated with an inert inorganic substance analogous to that on the layer, said inert inorganic substance constituting a lubricant.

6. A method according to claim 1, wherein the fibre glass layer is very thin and its weight per unit area lies between 10 g/m$^2$ and 50 g/m$^2$.

7. A method according to claim 1, wherein the inert inorganic substance on the layer is constituted substantially by a powdered material from the group consisting of talc and alumina.

* * * * *